US010544546B2

(12) United States Patent
Margo Moreno et al.

(10) Patent No.: US 10,544,546 B2
(45) Date of Patent: Jan. 28, 2020

(54) SOFT HIGH BASIS WEIGHT TISSUE

(71) Applicant: Kimberly-Clark Worldwide, Inc., Neenah, WI (US)

(72) Inventors: Oriol Margo Moreno, Forest Row (GB); John Alexander Werner, IV, New Milford, CT (US); Steven J. Hickey, Maidstone (GB); Paul David Bradford, Aylesford (GB); Cristiano Bobba, Vercelli (IT); Giovanni Massarotti, Novara (IT)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 15 days.

(21) Appl. No.: 15/966,090

(22) Filed: Apr. 30, 2018

(65) Prior Publication Data

US 2018/0245290 A1 Aug. 30, 2018

Related U.S. Application Data

(62) Division of application No. 15/537,964, filed as application No. PCT/US2015/021709 on Mar. 20, 2015, now Pat. No. 9,976,260.

(51) Int. Cl.

| | |
|---|---|
| ***D21F 11/14*** | (2006.01) |
| ***D21H 27/00*** | (2006.01) |
| ***B31F 1/12*** | (2006.01) |
| ***D21H 17/20*** | (2006.01) |
| ***D21H 21/14*** | (2006.01) |
| ***D21H 27/40*** | (2006.01) |

(52) U.S. Cl.

CPC ..... *D21H 27/005* (2013.01); *B31F 1/126* (2013.01); *D21F 11/14* (2013.01); *D21H 5/00* (2013.01); *D21H 17/20* (2013.01); *D21H 21/146* (2013.01); *D21H 27/002* (2013.01); *D21H 27/40* (2013.01)

(58) Field of Classification Search

USPC ..... 162/112

See application file for complete search history.

(56) References Cited

U.S. PATENT DOCUMENTS

| | | | |
|---|---|---|---|
| 3,879,257 | A | 4/1975 | Gentile |
| 4,158,594 | A | 6/1979 | Becker |
| 4,166,001 | A | 8/1979 | Dunning |
| 4,469,735 | A | 9/1984 | Trokhan |
| 4,574,021 | A | 3/1986 | Endres |
| 4,816,320 | A | 3/1989 | St. Cyr |
| 4,950,545 | A | 8/1990 | Walter |
| 5,164,046 | A | 11/1992 | Ampulski |
| 5,730,839 | A | 3/1998 | Wendt |
| 5,830,317 | A | 11/1998 | Vinson |
| 5,846,380 | A | 12/1998 | Van Phan |
| 5,968,853 | A | 10/1999 | Kelly |
| 5,981,044 | A | 11/1999 | Phan |
| 6,033,523 | A | 3/2000 | Dwiggins |
| 6,054,020 | A | 4/2000 | Goulet |
| 6,162,327 | A | 12/2000 | Batra |
| 6,241,850 | B1 | 6/2001 | Kelly |
| 6,332,952 | B1 | 12/2001 | Hsu |
| 6,454,901 | B1 | 9/2002 | Sekiya |
| 6,517,678 | B1 | 2/2003 | Shannon |
| 6,656,569 | B1 | 12/2003 | Roussel |
| 6,797,114 | B2 | 9/2004 | Hu |
| 6,821,387 | B2 | 11/2004 | Hu |
| 6,861,380 | B2 | 3/2005 | Garnier |
| 7,029,756 | B2 | 4/2006 | Moline |
| 7,517,433 | B2 | 4/2009 | Zwick |
| 7,785,443 | B2 | 8/2010 | Hermans |
| 7,803,249 | B2 | 9/2010 | Dyer |
| 7,807,023 | B2 | 10/2010 | Dyer |
| 7,879,190 | B2 | 2/2011 | Dyer |
| 7,883,604 | B2 | 2/2011 | Dyer |
| 8,025,764 | B2 | 9/2011 | Bhat |
| 8,070,913 | B2 | 12/2011 | Salaam |
| 8,123,905 | B2 | 2/2012 | Luu |
| 9,283,730 | B2 | 3/2016 | Zwick |
| 9,499,942 | B2 | 11/2016 | Zwick |
| 2002/0104630 | A1 | 8/2002 | Dwiggins |
| 2003/0121627 | A1 | 7/2003 | Hu |
| 2003/0131960 | A1 | 7/2003 | McConnell |
| 2003/0192662 | A1 | 10/2003 | Heath |
| 2004/0140076 | A1 | 7/2004 | Hermans |
| 2004/0163785 | A1 | 8/2004 | Shannon |
| 2004/0250969 | A1 | 12/2004 | Luu |
| GB | 2000196 | | 5/1979 |
| JP | 2013217004 | | 10/2013 |
| MX | 2014009286 | | 8/2014 |
| WO | 0800343 | | 1/2008 |
| WO | 1212102 | | 10/2012 |
| WO | WO15030750 | | 3/2015 |
| WO | WO16053309 | | 4/2016 |
| WO | 1613462 | | 9/2016 |

FOREIGN PATENT DOCUMENTS

| | | | |
|---|---|---|---|
| EP | 0144658 | A1 | 6/1985 |
| EP | 1112177 | B1 | 2/2012 |

(Continued)

*Primary Examiner* — Mark Halpern

(74) *Attorney, Agent, or Firm* — Kimberly-Clark Worldwide, Inc.

(57) ABSTRACT

The present invention provides multi-ply creped tissue products, and in particular embodiments creped wet pressed tissue products, having substantially higher per-ply basis weights, such as from about 20 to about 30 gsm, without the negative effects often associated with higher basis weight. As such, the tissue products are generally soft and flexible, having a softness value (measured as TS7) less than about 12.0 and a Stiffness Index less than about 20. While being soft and flexible, the instant tissue products are durable enough to withstand use, such as having a GMT greater than about 600 g/3" and a Burst Index greater than about 12.0.

7 Claims, 3 Drawing Sheets

(56) References Cited

U.S. PATENT DOCUMENTS

| | | | |
|---|---|---|---|
| 2005/0133175 | A1 | 6/2005 | Hada |
| 2006/0042767 | A1 | 3/2006 | Bhat |
| 2007/0062655 | A1 | 3/2007 | Knobloch |
| 2007/0131366 | A1 | 6/2007 | Underhill |
| 2007/0137810 | A1 | 6/2007 | Dyer |
| 2007/0144697 | A1 | 6/2007 | Dyer |
| 2008/0187733 | A1 | 8/2008 | Abbosh |
| 2009/0188637 | A1 | 7/2009 | Chan |
| 2009/0218058 | A1 | 9/2009 | Manifold |
| 2010/0051217 | A1 | 3/2010 | Allen |
| 2010/0155004 | A1 | 6/2010 | Soerens |
| 2010/0159200 | A1 | 6/2010 | Soerens |
| 2010/0186913 | A1 | 7/2010 | Super |
| 2010/0212849 | A1 | 8/2010 | Smith |
| 2010/0224338 | A1 | 9/2010 | Harper |
| 2011/0198776 | A1 | 8/2011 | Sekiya |
| 2011/0303374 | A1 | 12/2011 | Chan |
| 2011/0303375 | A1 | 12/2011 | Shannon |
| 2012/0125552 | A1 | 5/2012 | Goulet |
| 2012/0164200 | A1 | 6/2012 | Qin |
| 2012/0255694 | A1 | 10/2012 | Druecke |
| 2013/0029106 | A1 | 1/2013 | Lee |
| 2013/0199741 | A1 | 8/2013 | Stage |
| 2014/0050889 | A1 | 2/2014 | Zwick |
| 2014/0050890 | A1 | 2/2014 | Zwick |
| 2014/0096924 | A1 | 4/2014 | Rekoske |
| 2014/0209262 | A1 | 7/2014 | Hermans |
| 2014/0284010 | A1 | 9/2014 | Shannon |
| 2017/0350076 | A1 | 12/2017 | Margo Moreno |

SOFT HIGH BASIS WEIGHT TISSUE

RELATED APPLICATIONS

The present application is a divisional application and claims priority to U.S. patent application Ser. No. 15/537,964, filed on Jun. 20, 2017, which is a national-phase entry, under 35 U.S.C. § 371, of PCT patent application No. PCT/US15/21709, filed on Mar. 20, 2015, all of which are incorporated herein by reference.

BACKGROUND OF THE DISCLOSURE

Consumers desire a soft tissue, but they also want the tissue to be thick, absorbent and durable to protect their hands when they blow. The consumers' desires present a dilemma for the tissue maker—thickness and absorbency may be achieved by increasing the basis weight of the tissue, but at the expense of increasing stiffness which reduces softness. Increasing basis weight also impairs softness by making the tissue web more difficult to process by creping as conventional creping chemistries are limited in their ability to produce a fine crepe structure at higher basis weights.

As such, a need currently exists for a tissue product having low stiffness at higher basis weight such that the tissue maker may produce a soft, yet thick and absorbent tissue.

SUMMARY OF THE DISCLOSURE

Despite the tendency of increased basis weight, and in-turn sheet caliper, having a negative impact on creping, the present disclosure surprisingly provides a high basis weight web having low stiffness, improved softness and good durability. The novel tissue products generally have a per-ply basis weight greater than about 20 grams per square meter (gsm), such as from about 20 to about 25 gsm, while having a Stiffness Index less than about 20, such as from about 10 to about 20 and more preferably from about 10 to about 16. Thus, in certain embodiments, the tissue products comprise two plies and have a basis weight from about 40 to about 50 gsm and a Stiffness Index less than about 20, such as from about 10 to about 20 and more preferably from about 10 to about 16.

Not only do the present tissue products have relatively low stiffness given the basis weight, they also have surprisingly good absorbency. Generally as basis weight increases, the amount of liquid a tissue product can absorb per unit mass of fiber decreases. Here however, the tissue products have been produced at a high basis weight while maintaining a high level of absorbency. Thus, in one embodiment, the tissue products of the present invention comprise two plies wherein the basis weight of each ply is from about 20 to about 25 gsm and the product has a Specific Absorbency greater than about 7.0 g/g, such as from about 7.0 to about 10.0 g/g. Further, in certain embodiments the products comprise two plies wherein the basis weight of each ply is from about 20 to about 25 gsm and the product has a per-ply absorbency greater than about 20 g, such as from about 20 to about 24 g.

In still other aspects the present disclosure provides a multi-ply tissue product comprising two plies, each ply having a basis weight greater than about 20 gsm, the tissue product having a geometric mean tensile strength (GMT) from about 500 to about 900 g/3" and a Stiffness Index from about 14 to about 16.

In other aspects the present disclosure provides a creped, wet pressed tissue product comprising two or more plies, the plies each having a basis weight from about 20 to about 25 gsm, the product having a TS7 value from about 8.0 to about 10.5 and a Stiffness Index from about 14 to about 16.

In yet other aspects the disclosure provides a creped tissue product comprising two or more plies, the plies each having a basis weight from about 20 to about 25 gsm, the product having a geometric mean stretch (GM Stretch) greater than about 14 percent, such as from about 14 to about 16 percent, and a geometric mean slope (GM Slope) less than about 14, such as from about 8.0 to about 14.

In still other aspects the present invention provides a creped, wet pressed tissue product having a basis weight from about 40 to about 50 gsm, a machine-direction stretch (MD Stretch) greater than about 30 percent, a GMT from about 500 to about 900 g/3" and a Stiffness Index from about 14 to about 16.

In other aspects the present invention provides a creped tissue product, and more preferably a creped, wet-pressed, tissue product having two plies, the product having a basis weight from about 40 to about 60 gsm, and more preferably from about 44 to about 56 gsm, a geometric mean stretch (GM Stretch) greater than about 14 percent, such as from about 14 to about 16 percent, and a geometric mean slope (GM Slope) less than about 14, such as from about 8.0 to about 14.

Other features and aspects of the present disclosure are discussed in greater detail below.

DEFINITIONS

Figure 1:
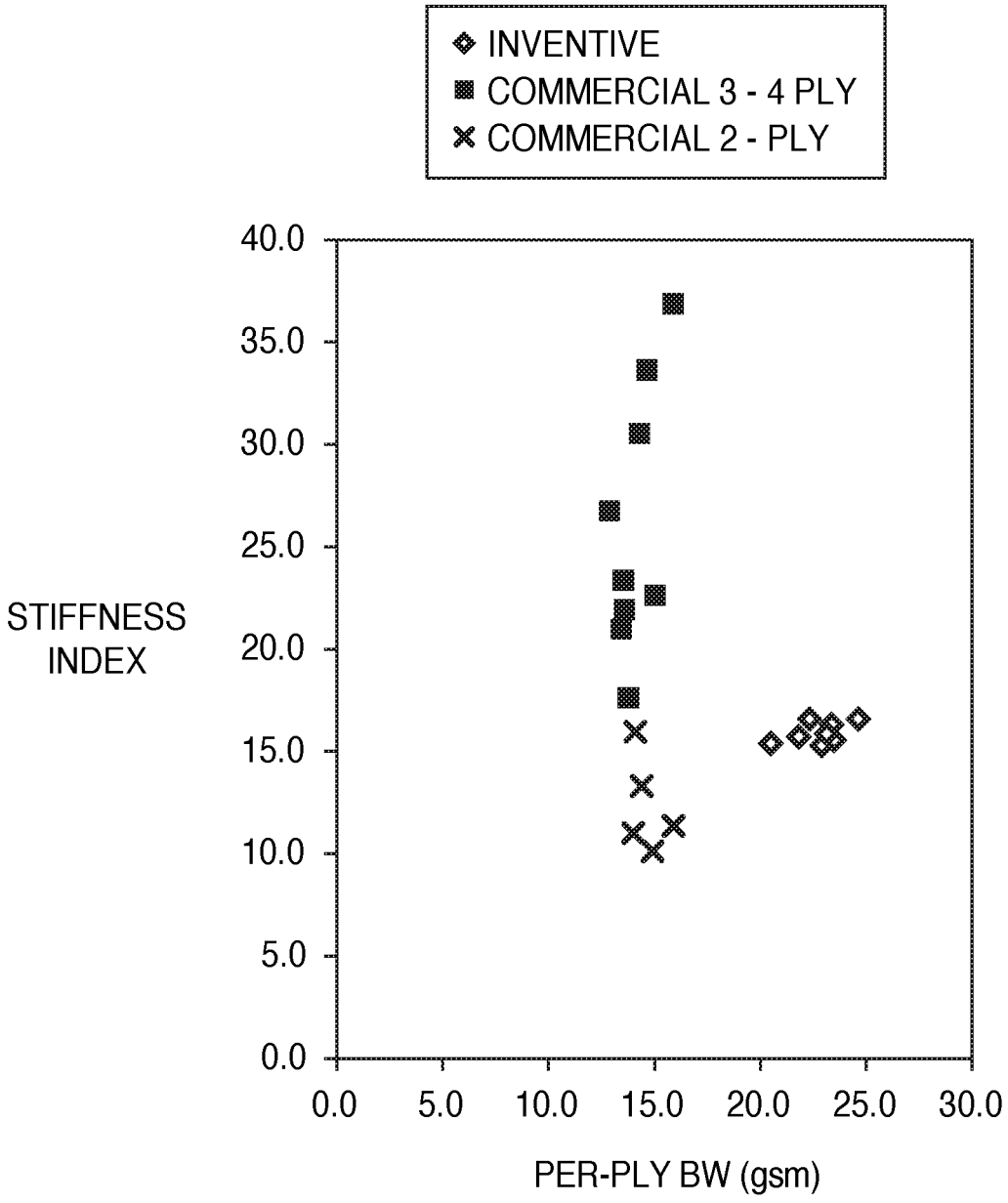
FIG. 1 is a graph plotting the per-ply basis weight (x-axis) versus Stiffness Index (y-axis) for inventive and commercial tissue products.

As used herein, the term "basis weight" generally refers to the bone dry weight per unit area of a tissue and is generally expressed as grams per square meter (gsm). Basis weight is measured using TA PPI test method T-220. While the basis weight of individual tissue plies may vary, inventive tissue products of the present invention generally comprise plies having a basis weight greater than about 20 gsm, such as from about 20 to about 25 gsm.

As used herein, the term "Burst Index" refers to the dry burst peak load (typically having units of grams) at a relative geometric mean tensile strength (typically having units of g/3") as defined by the equation:

$$\text{Burst Index} = \frac{\text{Dry Burst Peak Load (g)}}{GMT\ (g/3")} \times 10$$

While Burst Index may vary, tissue products prepared according to the present disclosure generally have a Burst Index greater than about 12, such as from about 12 to about 20.

As used herein, the term "conventional creping composition" generally refers to a composition applied to the surface of a creping cylinder during the manufacture of creped tissue products, the composition comprising a water soluble polymer selected from the group consisting of polyamidoamine-epichlorohydrin resin, polyamine-epichlorohydrin resin, polyvinyl alcohol, polyvinylamine, polyethyleneimine, polyacrylamide, polymethacrylamide, poly (acrylic acid), poly(methacrylic acid), poly(hydroxyethyl acrylate), poly(hydroxyethyl methacrylate), poly(n-vinyl pyrrolidinone), poly(ethylene oxide), hydroxyethyl cellulose, hydroxypropyl cellulose, guar gum, starch, agar, chitosan, alginic acid, carboxymethyl cellulose, highly branched polyamidoamines and their reaction product with epichlorohydrin and silyl-linked polyamidoamines.

As used herein, the term "caliper" is the representative thickness of a single sheet (caliper of tissue products comprising two or more plies is the thickness of a single sheet of tissue product comprising all plies) measured in accordance with TA PPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g) or kilograms (kg).

As used herein, the term "geometric mean slope" (GM Slope) generally refers to the square root of the product of machine direction slope and cross-machine direction slope. GM Slope generally is expressed in units of kilograms (kg). While GM Slope may vary, tissue products prepared according to the present disclosure generally have a GM Slope less than about 15.0 kg such as from about 8.0 to about 15.0 kg.

As used herein, the terms "geometric mean tensile" and "GMT" refer to the square root of the product of the machine direction tensile strength and the cross-machine direction tensile strength of the web. While the GMT may vary, tissue products prepared according to the present disclosure generally have a GMT greater than about 500 g/3", more preferably greater than about 600 g/3" and still more preferably greater than about 600 g/3" such as from about 600 to about 900 g/3".

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Stiffness Index" refers to the quotient of the geometric mean tensile slope, defined as the square root of the product of the MD and CD slopes (typically having units of kg), divided by the geometric mean tensile strength (typically having units of g/3").

$$\text{Stiffness Index} = \frac{\sqrt{MD\ \text{Tensile Slope (kg)} \times CD\ \text{Tensile Slope (kg)}}}{GMT\ (g/3")} \times 1{,}000$$

While the Stiffness Index may vary tissue products prepared according to the present disclosure generally have a Stiffness Index less than about 18.0, such as from about 12.0 to about 18.0.

As used herein, the term "TEA Index" refers the geometric mean tensile energy absorption (typically having units of g·cm/cm$^2$) at a given geometric mean tensile strength (typically having units of g/3") as defined by the equation:

$$TEA\ \text{Index} = \frac{GM\ \ TEA(\text{g}\cdot\text{cm/cm2})}{GMT\ (g/3")} \times 1{,}000$$

While the TEA Index may vary, tissue products prepared according to the present disclosure generally have a TEA Index greater than about 25, such as from about 25 to about 32.

As used herein, the term "TS7" refers to the output of the EMTEC Tissue Softness Analyzer (commercially available from Emtec Electronic GmbH, Leipzig, Germany) as described in the Test Methods section. TS7 has units of dB V2 rms, however, TS7 may be referred to herein without reference to units.

As used herein, a "tissue product" generally refers to various paper products, such as facial tissue, bath tissue, paper towels, napkins, and the like. Normally, the basis weight of a tissue product of the present invention is greater than about 40 grams per square meter (gsm), such as from about 40 to about 60 gsm and more preferably from about 42 to about 50 gsm.

DETAILED DESCRIPTION OF THE DISCLOSURE

In general, the present disclosure is directed to multi-ply tissue products wherein each ply has a relatively high basis weight, such as greater than about 20 gsm. Despite the relatively high per-ply basis weight, the tissue products have comparable or better physical properties, such as softness (measured as TS7, where a lower value indicates a softer product) and stiffness, compared to tissue products comprising plies having modest basis weights, such as from about 10 to about 15 gsm. The discovery that a tissue product, and particularly a creped tissue product, having both relatively high basis weight and low stiffness is surprising because increased basis weight generally negatively effects creping performance. When creping performance is diminished the tissue product has a coarser crepe structure, the product is stiffer and softness is decreased.

The negative effects often associated with increasing basis weight have been overcome by altering the creping conditions to alter the mechanical properties of the tissue web, particularly the machine-direction (MD) properties and more specifically the MD stretch. As such, the tissue products of the present invention generally have a relatively high degree of MD stretch, such as greater than about 20 percent, such as from about 30 to about 50 percent and more preferably from about 35 to about 45 percent.

The increase in MD stretch is accompanied by a modest increase in cross-machine direction (CD) stretch, such that the tissue products of the present invention generally have a CD stretch greater than about 5.0 percent, such as from about 5.0 to about 7.0 percent. As such the tissue products generally have a geometric mean stretch (GM stretch) greater than about 12 percent, such as from about 12 to about 16 percent.

The increase in the stretch of the tissue products is achieved without a loss in tensile strength, such that the tissue products generally have a GMT greater than about 500 g/3", and more preferably greater than about 600 g/3" and still more preferably greater than about 700 g/3", such as from about 700 to about 900 g/3". At the foregoing tensile strengths the products generally have geometric mean slope (GM Slope) less than about 15.0 kg, such that the Stiffness Index is less than about 18.0, and more preferably less than about 16.0, such as from about 12.0 to about 16.0.

Figure 2:
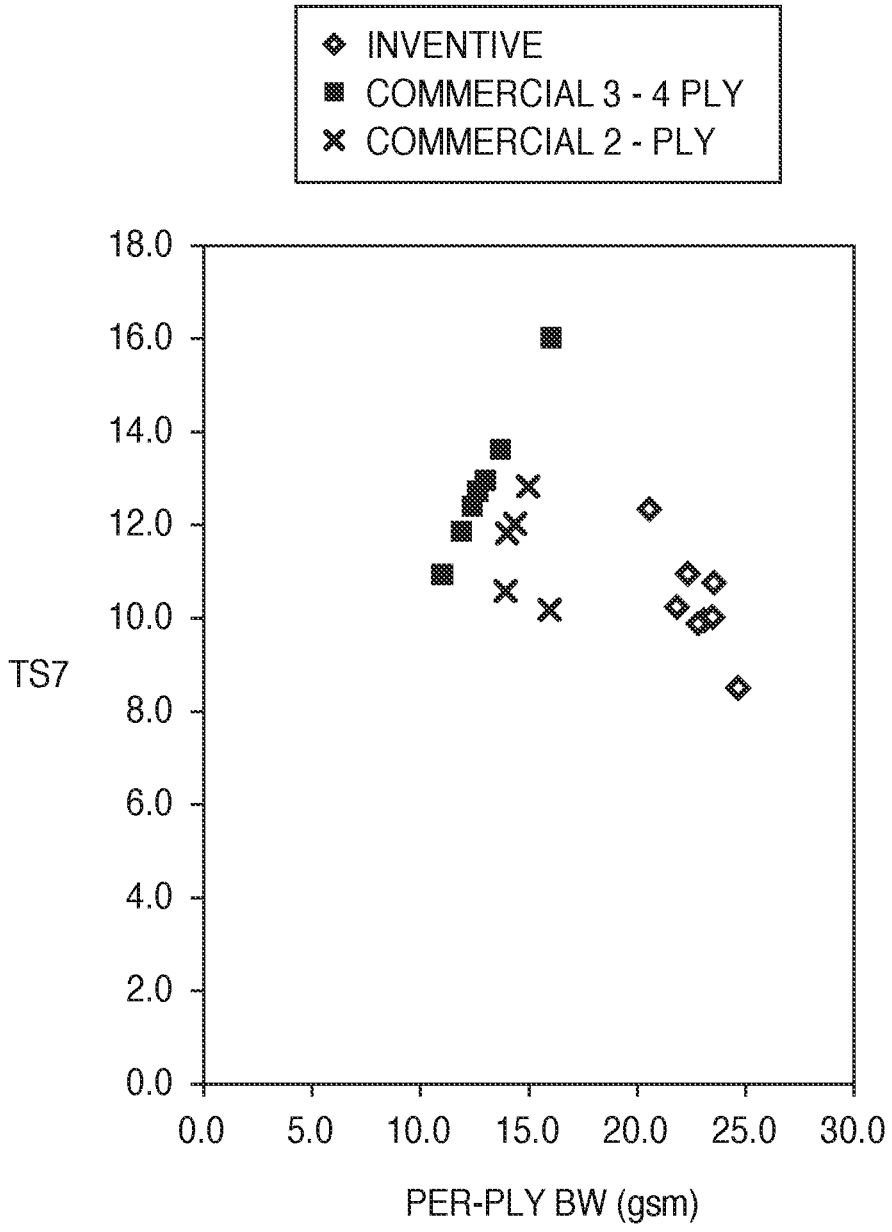
FIG. 2 is a graph plotting the per-ply basis weight (x-axis) versus TS7 (y-axis) for inventive and commercial tissue products.
Figure 3:
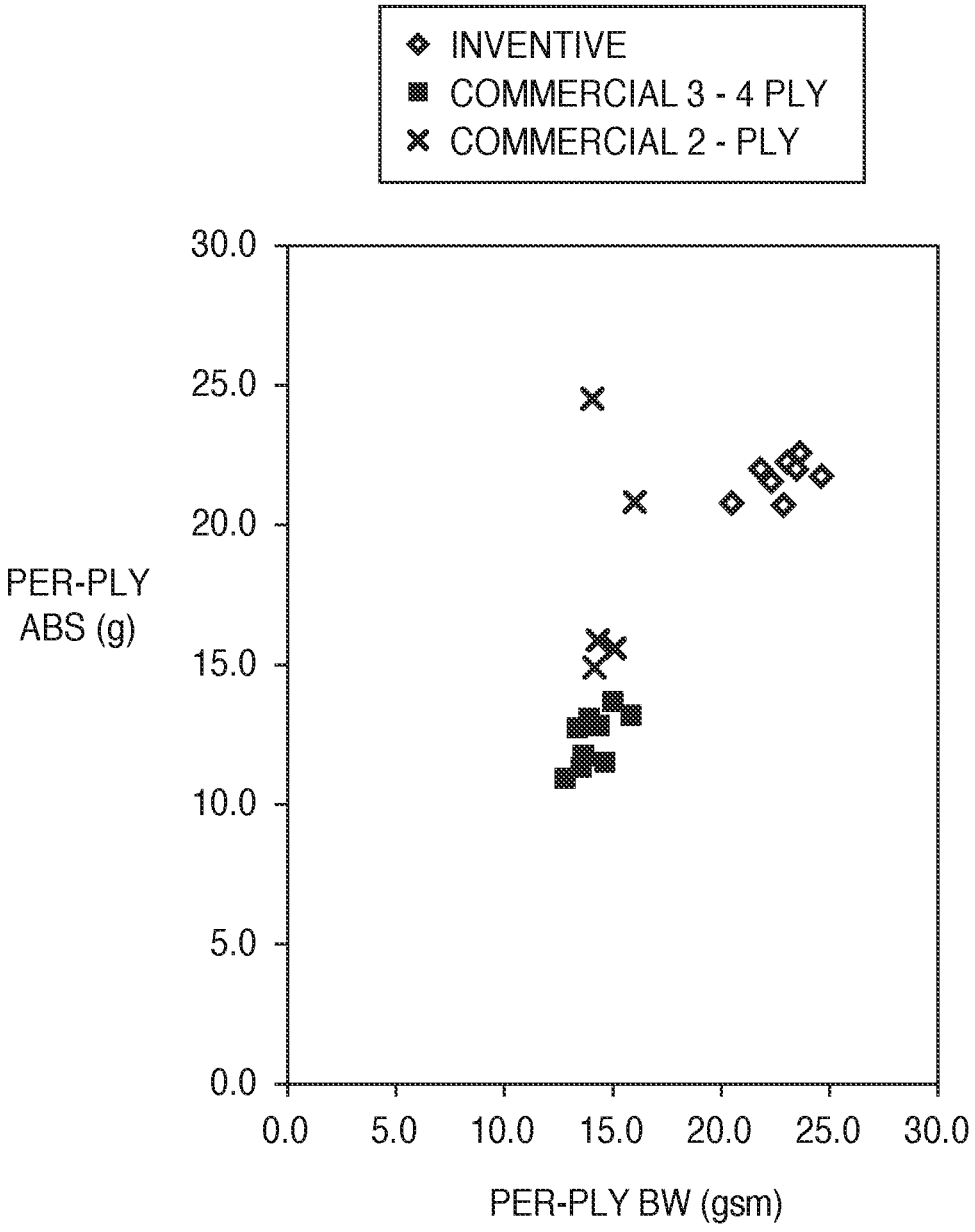
FIG. 3 is a graph plotting the per-ply basis weight (x-axis) versus per-ply Absorbency (y-axis) for inventive and commercial tissue products

The decrease in stiffness is reflected in the tissue products generally having TS7 values (a measure of softness where a lower value indicates a softer tissue) less than about 12.0, such as from about 9.0 to about 12.0 and more preferably from about 9.0 to about 11.0. The relatively low TS7 values are achieved despite the products having increased basis weight. As illustrated in FIG. 2, TS7 is generally negatively affected by increases in basis weight. The present inventors however, have discovered that by altering the mechanical properties of the tissue product, particularly the machine and cross-direction stretch, basis weight may be increased without negatively affecting softness. In fact, in certain embodiments TS7 value may be decreased as basis weight is increased.

Compared to commercially available tissue products, tissue products prepared according to the present disclosure, despite having higher per-ply basis weight, are generally softer (measured as TS7—a lower value indicates a softer product), less stiff (measured as Stiffness Index) and have higher GM Stretch, as illustrated in Table 1 below.

TABLE 1

| Sample | Plies | Per-Ply BW (gsm) | GMT (g/3") | Stiffness Index | TS7 | GM Stretch (%) |
|---|---|---|---|---|---|---|
| Kleenex ® Mainline Facial Tissue | 2 | 15.9 | 815 | 11.3 | 9.8 | 11.6 |
| Puffs ® Facial Tissue | 2 | 14.0 | 710 | 11.0 | 10.6 | 12.2 |
| Puffs Ultra Strong and Soft ® Facial Tissue | 2 | 14.4 | 749 | 13.3 | 12.0 | 11.2 |
| Scotties ® Facial Tissue | 2 | 14.9 | 1036 | 10.1 | 12.8 | 8.1 |
| Publix ® Facial Tissue | 2 | 14.1 | 827 | 16.0 | 11.8 | 9.0 |
| Scottex ® Facial Tissue | 4 | 12.9 | 1096 | 26.7 | 12.4 | 10.4 |
| Linsoft ® Classic Facial Tissue | 4 | 13.6 | 685 | 21.9 | 11.9 | 10.1 |

TABLE 1-continued

| Sample | Plies | Per-Ply BW (gsm) | GMT (g/3") | Stiffness Index | TS7 | GM Stretch (%) |
|---|---|---|---|---|---|---|
| Tempo ® Classic Soft & Extra Strong | 4 | 13.5 | 1114 | 23.4 | 12.4 | 9.3 |
| Inventive | 2 | 22.9 | 815 | 15.3 | 9.9 | 14.5 |

"Itering manufacturing conditions such as basis weight, crepe ratio, the amount of creping composition add-on and the ratio of adhesive and release agents in the creping not only results in a tissue product having improved stretch, slope and stiffness, it also yields a tissue product having good absorbency. For example, tissue products prepared according to the present disclosure generally have a Specific "bsorbency greater than about 7.0 g/g despite comprising plies having a basis weight greater than about 20 gsm. Similarly, the tissue products have an "bsorbent Capacity greater than about 40 g and more preferably greater than about 42 g, such as from about 42 to about 45 g. In particular embodiments the tissue products of the present invention comprise two plies, wherein each ply has a basis weight from about 20 to about 25 gsm, and have an "bsorbent Capacity greater than about 40 g and more preferably greater than about 42 g.

The foregoing tissue properties may be achieved using a conventional creping composition during the manufacture of the tissue products. Not only may the tissue products be prepared using conventional creping compositions, the desirable physical properties may be achieved without the use of surface modifiers, such as thermoplastic resins and more particularly a non-fibrous olefin polymers disclosed in U.S. Pat. No. 7,807,023. The use of thermoplastic resins as components of the creping composition typically increase the cost of manufacture, introduces manufacturing complexities, and may compromise one or more important physical properties such as rate of absorbency. Thus, in particularly preferred embodiments, the tissue products of the present invention are creped using conventional creping compositions. Moreover, in particularly preferred embodiments the tissue products are prepared using conventional creping compositions at relatively modest add-on levels, such as less than about 10 mg per square meter of dryer surface area.

In other embodiments, the inventive tissue products may be produced without the addition of oils, waxes, silicones, latexes, fatty alcohols, or lotions comprising one or more emollients during manufacture of the tissue web or by post-treatment. For example, tissue webs and products prepared therefrom, according to the present invention, are formed without the addition of oils, waxes, silicones, latexes, fatty alcohols, or lotions comprising one or more emollients. Similarly, it is preferred that tissue webs are not post-treated, i.e., subjected to treatment by printing, spraying, coating, or the like, after formation and drying of the tissue web, with oils, waxes, silicones, latexes, fatty alcohols, or lotions comprising one or more emollients.

When manufacturing the tissue products of the present invention, it may be desirable not only to increase the per ply basis weight to greater than about 20 gsm and crepe using conventional creping compositions, it may be desirable to form a tissue product having fewer than four plies. Thus, in certain embodiments the tissue product of the present invention comprises three or fewer plies and in a particularly preferred embodiment two plies and has a total basis weight from about 40 to about 60 gsm, such as from about 42 to about 58 gsm, and more preferably from about 44 to about 56 gsm. Despite having fewer than four plies, the tissue products are generally strong enough to withstand use, having GMT greater than about 600 g/3", such as from about 600 to about 1,000 g/3" and are absorbent, having an Absorbent Capacity greater than about 40 g.

Regardless of the exact construction, the tissue products of the present invention generally comprise cellulosic fibers and more preferably conventional cellulosic fibers. Conventional cellulosic fibers may comprise wood pulp fibers formed by a variety of pulping processes, such as kraft pulp, sulfite pulp, thermomechanical pulp, etc. Further, the wood fibers may have any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood fibers include hardwood fibers, such as, but not limited to, eucalyptus, maple, birch, aspen, and the like, which can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In general, any process capable of forming a base sheet may be utilized in the present disclosure. For example, an endless traveling forming fabric, suitably supported and driven by rolls, receives the layered papermaking stock issuing from the headbox. Once retained on the fabric, the layered fiber suspension passes water through the fabric. Water removal is achieved by combinations of gravity, centrifugal force and vacuum suction depending on the forming configuration. Forming multi-layered paper webs is also described and disclosed in U.S. Pat. No. 5,129,988, which is incorporated herein by reference in a manner that is consistent herewith.

Preferably the formed web is dried by transfer to the surface of a rotatable heated dryer drum, such as a Yankee dryer. In accordance with the present disclosure, the creping composition may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. Creping the web, as it is formed, further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The web is adhered to the surface of the dryer drum and then creped from the drum using the creping blade. If desired, the dryer drum may be associated with a hood. The hood may be used to force air against or through the web.

Additionally tissue products of the present invention may be prepared by applying a creping composition at relatively high addition levels, such as greater than about 10 mg of solids per square meter of the creping surface (mg/m$^2$), such as a Yankee Dryer. In certain preferred embodiments the level of total solids add-on is from about 10 to about 50 mg/m$^2$ and more preferably from about 15 to about 30 mg/m$^2$. The level of total solids add-on is preferably several times greater than traditional creping methods, which have typically employed add-on levels from about 2 to about 10 mg/m$^2$. Even at the increased add-on levels the present disclosure provides creping compositions that balance adhesion and release of the web from the Yankee Dryer, without the build-up of deposits of organic and/or inorganic components that can have a negative impact on creping efficiency.

To achieve the desired creping efficiency and tissue product properties, tissue webs may be creped using a conventional creping composition comprising at least one, and more preferably at least two, water-soluble polymers. For purposes herein, "water-soluble" means that the polymers dissolve completely in water to give a solution as opposed to a latex, dispersion, or suspension of undissolved particles. Suitable water soluble polymers may be selected from the group consisting of polyamidoamine-epichlorohydrin resin, polyamine-epichlorohydrin resin, polyvinyl alcohol, polyvinylamine, polyethyleneimine, polyacrylamide, polymethacrylamide, poly(acryiic acid), poly(methacrylic acid), poly (hydroxyethyl acrylate), poly(hydroxyethyl methacrylate), poly(n-vinyl pyrrolidinone), poly(ethylene oxide), hydroxyethyl cellulose, hydroxypropyl cellulose, guar gum, starch, agar, chitosan, alginic acid, carboxymethyl cellulose, highly branched polyamidoamines and their reaction product with epichlorohydrin and silyl-linked polyamidoamines.

In one embodiment the conventional creping composition comprises a water-soluble polymer such as an aqueous solution comprising a polyether, a polyamide, or a mixture of one or both with another water-soluble polymer. Suitable polyethers include (poly)ethylene oxide, (poly)propylene oxide, ethylene oxide/propylene oxide copolymers, (poly) tetra methylene oxide, poly vinyl methyl ether, and the like. Suitable polyamides include (poly)vinylpyrrolidone, (poly) ethyl oxazoline, (poly)amidoamine, (poly)acrylamide, polyethylene imine, and the like. Number of average molecular weights for these components should be from about 10,000 to about 500,000.

Other water-soluble polymers which can be mixed with either of the water-soluble polymeric components used to form the creping composition include polyvinyl alcohol (PVOH), carboxymethylcellulose, hydroxypropyl cellulose, and the like.

In certain embodiments the creping composition may further comprise a polymeric component having an affinity for the fibers making up the web, such as a cationic polymer, and more specifically a cationic starch. As used herein the term "cationic starch" refers to a starch that has been chemically modified to impart a cationic constituent moiety. Suitable cationic polymers include cationic starches having a charge density of at least about 0.1 mEq/g, such as, for example, Redibond™ 2038 (Ingredion Incorporated, Westchester, Ill.) which has a charge density of about 0.22 mEq/g.

Particularly preferred cationic starches for use in the creping composition of the present disclosure are the tertiary aminoalkyl ethers and quaternary ammonium alkyl ethers, which include commercial cationic starches produced by Ingredion Incorporated, Westchester, Ill., under the trade names Redibond™ and Optipro™. Grades with cationic moieties only such as Redibond 5327™, Redibond 5330A™, and Optipro™ 650 are suitable, as are grades with additional anionic functionality such as Redibond 2038™.

The cationic component can be present in the creping composition in any operative amount and will vary based on the chemical component selected, as well as on the end properties that are desired. For example, in the exemplary case of Redibond 2038™, the cationic component can be present in the creping composition in an amount of about 10 to 90 wt %, such as 20 to 80 wt % or 30 to 70 wt % based on the total weight of the creping composition, to provide improved benefits.

Other suitable cationic components include cationic debonders and/or softeners. Cationic debonders and softeners are known in the papermaking art and are generally used as wet-end additives to enhance bulk and softness. Debonders are generally hydrophobic molecules that have a cationic charge. As wet end additives debonders function typically by disrupting inter-fiber bonding thereby increasing bulk and increasing perceived softness, but at the expense of a decrease in sheet strength. Softening agents are similar in chemistry to debonders, i.e., they are generally hydrophobic molecules that have a cationic charge. Examples of debonders and softening chemistries may include the simple quaternary ammonium salts having the general formula:

$$(R^{1'})_{4-b}—N^{+}—(R^{1''})_{b}X^{-}$$

wherein $R^{1'}$ is a $C_{1-6}$ alkyl group, $R^{1''}$ is a $C_{14-22}$ alkyl group, b is an integer from 1 to 3 and $X^{-}$ is any suitable counterion. Other similar compounds may include the monoester, diester, monoamide, and diamide derivatives of the simple quaternary ammonium salts. A number of variations on these quaternary ammonium compounds should be considered to fall within the scope of the present invention. Additional softening compositions include cationic oleyl imidazoline materials such as methyl-1-oleyl amidoethyl-2-oleyl imidazo linium methylsulfate commercially available as Mackernium CD-183 (McIntyre Ltd., University Park, Ill.) and Prosoft TQ-1003 (Ashland, Inc., Covington, Ky.).

As an option, creping adhesive compositions can be applied to the Yankee surface as the sole active agent, or optionally with a release aid, and further optionally with a phosphate donor or other additives and resins, through the same spray boom or other coating applicator. As an option, creping adhesives alone or in combination with release agents can be applied to the surface of the dryer in order to provide the appropriate adhesion to produce the desired crepe. As generally understood, the adhesive portion and any release aids used in the coating composition may migrate differentially as between a hot Yankee surface and the opposite web surface.

In a particularly preferred embodiment the creping composition comprises a creping adhesive component and a release component, both of which may be a water soluble cationic polyamide-epihalohydrin, which is the reaction product of an epihalohydrin and a polyamide containing secondary amine groups or tertiary amine groups. Commercially available polyamide-epihalohydrins are sold under the trade names including Kymene™, Crepetrol™ and Rezosol™ (Ashland Water Technologies, Wilmington, Del.) and Bubond™ (Buckman Laboratories International Inc., Memphis, Tenn.). Suitable adhesive agents include, for example, polyamidoamine epichlorohydrin polymers, such as those sold under the trade name Crepetrol™, such as Crepetrol™ A2320. Suitable release agents include, for instance, polyamidoamine epichlorohydrin polymers, such as those sold under the trade name Rezosol™. Particular release agents that may be used in the present disclosure include and Bubond™ series release agents, such Bubond™ 2062, Bubond™ 2624 (commercially available from Buckman Laboratories International inc., Memphis, Tenn. USA). In certain embodiments the adhesive agent is added to the dryer at higher levels than the release agent, such that the ratio of adhesive agent to release agent (on a mass basis) is from about 2:1 to about 2:1.5.

Test Methods

Absorbency

Absorbent capacity is determined by first cutting 20 sheets of a sample, each sheet measuring 3"×3" and stapling the 20 sheets together at the edges to form a test specimen. A test specimen is then weighed. The weighed specimen is then soaked in a pan of test fluid (e.g. paraffin oil or water) for three minutes. The test fluid should be at least 2 inches (5.08 cm) deep in the pan. The specimen is removed from the test fluid and allowed to drain while hanging in a "diamond" shaped position (i.e. with one corner at the lowest point). The specimen is allowed to drain for three minutes for water and for five minutes for oil. After the allotted drain time the specimen is placed in a weighing dish and then weighed. Absorbent Capacity (g)=wet weight (g)−dry weight (g) and Specific Absorbent Capacity (g/g)=Absorbent Capacity (g)/dry weight (g).

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings have an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TA PPI conditions and cut into 127×127±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

Tensile

Tensile testing was done in accordance with TA PPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm). The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

For multiple-ply products tensile testing is done on the number of plies expected in the finished product. For example, 2-ply products are tested two plies at one time and the recorded MD and CD tensile strengths are the strengths of both plies.

Tissue Softness

Tissue softness was analyzed using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. The frequency analysis in the range of approximately 200 to 1000 Hz represents the surface smoothness or texture of the test piece. A high amplitude peak correlates to a rougher surface. A further peak in the frequency range between 6 and 7 kHZ represents the softness of the test piece. The peak in the frequency range between 6 and 7 kHZ is herein referred to as the TS7 Softness Value and is expressed as dB V2 rms. The lower the amplitude of the peak occurring between 6 and 7 kHZ, the softer the test piece.

Test samples were prepared by cutting a circular sample having a diameter of 112.8 mm. All samples were allowed to equilibrate at TA PPI standard temperature and humidity conditions for at least 24-hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the TS7 Softness Values measurements are started via the PC. The PC records, processes and stores all of the data according to standard TSA protocol. The reported TS7 Softness Value is the average of 5 replicates, each one with a new sample.

EXAMPLES

Samples were made using a conventional wet pressed tissue-making process on a commercial tissue machine. Initially, northern softwood kraft (NSWK) pulp was dispersed in a pulper for 30 minutes at about 6 percent consistency at about 100° F. The NSWK pulp was refined in a batch refiner to a Canadian Standard Freeness (CSF) value of about 450 ml. The NSWK pulp was then transferred to a dump chest and subsequently diluted with water to approximately 3.5 percent consistency. Softwood fibers were then pumped to a machine chest where they were further diluted with water to a consistency of about 3 percent and mixed with 1.25 kg/MT of Kymene® 920A on a dry-solids basis (Ashland Water Technologies, Wilmington, Del.) and with 1 to 4 kg/MT of Amylofax® 2200 on a dry solids basis (Avebe) prior to the headbox. The softwood fibers were added to the middle layer in the 2-layer tissue structure. The NSWK content contributed approximately 40 to 50 percent of the final sheet weight. The specific layer splits (dryer layer/felt layer) are as set forth in Table 2.

Eucalyptus hardwood kraft (EHWK) pulp was dispersed in a pulper for 30 minutes at about 6 percent consistency at about 100° F. The EHWK pulp was then transferred to a dump chest and diluted to about 3.5 percent consistency. The EHWK pulp was then pumped to a machine chest where they were further diluted with water to a consistency of about 3 percent and mixed with 1.25 kg/MT of Kymene® 920A. These fibers were added to the dryer and felt layers of the 2-layer sheet structure and contributed approximately 50 to 60 percent of the final sheet weight. The specific layer splits (dryer layer/felt layer) are as set forth in Table 2.

The pulp fibers from the machine chests were pumped to the headbox at a consistency of about 0.02 percent. Pulp fibers from each machine chest were sent through separate manifolds in the headbox to create a 2-layered tissue structure. The fibers were deposited onto a Microtex T230 Superfinefabric (Albany International) in an S-Wrap Twin Wire type of former.

The wet sheet from the forming fabric, at about 10 percent consistency, was vacuum dewatered and then transferred to a Tissue Flex V3 press felt (Voith Paper). The wet tissue sheet, supported by the press felt, was passed through the nip of a pressure roll, in order to partially dewater the sheet to a consistency of about 40 percent. The wet sheet was then adhered the Yankee dryer by spraying the creping composition onto the dryer surface using a spray boom situated underneath the dryer.

TABLE 2

| Sample | Layer Splits (% HW/% SW) | Creping Composition Total " dd-on ($mg/m^2$) | " dhesive " agent ($mg/m^2$): Release " gent ($mg/m^2$) |
|---|---|---|---|
| 1 | 67/33 | 17.5 | 9:6.5 |
| 2 | 64/36 | 17.5 | 9:6.5 |
| 3 | 64/36 | 17.5 | 9:6.5 |
| 4 | 59/41 | 17.5 | 9:6.5 |
| 5 | 58/42 | 17.5 | 9:6.5 |
| 6 | 55/45 | 17.5 | 9:6.5 |
| 7 | 50/50 | 17.5 | 9:6.5 |

The creping compositions generally comprised a mixture of Crepetrol™ A2320 (adhesive agent) and Rezosol™ 4119 (release agent) (Ashland Water Technologies, Wilmington, Del.). The creping compositions used to produce each of the samples is detailed in Table 2. Creping compositions were prepared by dissolution of the solid polymers into water followed by stirring until the solution was homogeneous. Individual polymers were diluted depending on the desired spray coverage on the Yankee dryer. Alternatively, flow rates of the polymer solutions were varied to provide the desired amount of solids to the base web.

The sheet was dried to about 98 percent consistency as it traveled on the Yankee dryer and to the creping blade. The Yankee dryer was heated with 65 to 75 psi of steam pressure to dry the sheet to a target sheet temperature of 240° F. before the creping blade. The Yankee dryer was traveling at about 4000 FPM, unless otherwise noted. The creping blade, an 75 Vantage+Durablade® (BTG, Eclépens, Switzerland) with a 15 degree grind angle, was loaded at a pressure of 1.7 plig. The creping blade subsequently scraped the tissue sheet off of the Yankee dryer. The crepe ratio was 1.33 or 33 percent. The creped tissue base sheet was then wound onto a core traveling at about 3000 FPM into soft rolls for converting.

This tissue was plied together and calendered with two steel rolls at 20 pounds per lineal inch. The 2-ply product had the dryer/softener layer plied to the outside. The resulting tissue products were subject to physical testing as described above, the results of which are summarized in the tables below.

TABLE 3

| Sample | Per-Ply Basis Weight (gsm) | Caliper (μm) | " bsorbent Capacity (g) | Specific " bsorbent Capacity (g/g) | Per-Ply " bsorbency (g) | Burst Index |
|---|---|---|---|---|---|---|
| 1 | 22.3 | 240.9 | 43.1 | 7.7 | 21.6 | 13.70 |
| 2 | 23.1 | 265.7 | 44.6 | 9.6 | 22.3 | 14.96 |
| 3 | 22.9 | 206.3 | 41.5 | 7.3 | 20.8 | 14.62 |

TABLE 3-continued

| Sample | Per-Ply Basis Weight (gsm) | Caliper (μm) | " bsorbent Capacity (g) | Specific " bsorbent Capacity (g/g) | Per-Ply " bsorbency (g) | Burst Index |
|---|---|---|---|---|---|---|
| 4 | 23.5 | 244.6 | 44.9 | 7.8 | 22.4 | 16.27 |
| 5 | 23.4 | 260.2 | 44.2 | 7.4 | 22.1 | 13.76 |
| 6 | 24.6 | 272.8 | 43.7 | 7.1 | 21.8 | 13.50 |
| 7 | 20.5 | 235.7 | 41.8 | 8.2 | 20.9 | 14.93 |

TABLE 4

| Sample | GMT (g/3") | MD Stretch (%) | GM Stretch (%) | GM Slope (kg) | Stiffness Index | TS7 |
|---|---|---|---|---|---|---|
| 1 | 796.1 | 36.1 | 14.8 | 13.2 | 16.6 | 11.0 |
| 2 | 697.4 | 35.9 | 14.8 | 11.1 | 15.9 | 10.0 |
| 3 | 814.9 | 33.2 | 14.5 | 12.5 | 15.3 | 9.9 |
| 4 | 713.9 | 33.2 | 14.1 | 11.1 | 15.6 | 10.8 |
| 5 | 771.3 | 35.4 | 13.9 | 12.6 | 16.3 | 10.0 |
| 6 | 783.8 | 29.7 | 14.0 | 13.0 | 16.6 | 8.5 |
| 7 | 623.9 | 36.4 | 15.8 | 9.6 | 15.4 | 12.3 |

While the invention has been described in detail with respect to the foregoing specification and examples, the following embodiments, as well as equivalents thereof of, are within the scope of the invention. Thus, in a first embodiment the present invention provides a creped tissue product comprising two or more plies, each ply having a basis weight greater than about 20.0 gsm, the tissue product having a geometric mean tensile (GMT) greater than about 600 g/3" and a Stiffness Index less than about 20.

In a second embodiment the present invention provides the creped tissue product of the first embodiment having a MD Stretch greater than about 20 percent.

In a third embodiment the present invention provides the creped tissue product of the first or second embodiments having a MD Stretch from about 30 to about 35 percent.

In a fourth embodiment the present invention provides the creped tissue product of any one of the first through third embodiments having a geometric mean stretch (GM Stretch) greater than about 12 percent.

In a fifth embodiment the present invention provides the creped tissue product of any one of the first through fourth embodiments having a CD Stretch from about 5.0 to about 7.0 percent.

In a sixth embodiment the present invention provides the creped tissue product of any one of the first through fifth embodiments having a GMT from about 700 to about 900 g/3" and a geometric mean slope (GM Slope) from about 10 to about 15.

In a seventh embodiment the present invention provides the creped tissue product of any one of the first through sixth embodiments having a TS7 value less than about 12.0.

In an eighth embodiment the present invention provides the creped tissue product of any one of the first through seventh embodiments having a GMT from about 700 to about 900 g/3", a Stiffness Index from about 15.0 to about 17.0 and wherein each ply has a basis weight from about 22.0 to about 25.0 gsm.

In a ninth embodiment the present invention provides the creped tissue product of any one of the first through eighth embodiments having two plies and a basis weight from about 40.0 to about 60.0 gsm and more preferably from about 44.0 to about 54.0 gsm.

In a tenth embodiment the present invention provides a creped wet pressed tissue product comprising two plies, each ply having a basis weight from about 20.0 to about 25.0 gsm, the product having a GM Stretch from about 12 to about 16 percent, a GMT from about 600 to about 900 g/3" and a Stiffness Index less than about 20.

In an eleventh embodiment the present invention provides a creped wet pressed tissue product of the tenth embodiment having a MD Stretch from about 30 to about 35 percent and a CD Stretch from about 5.0 to about 7.0 percent.

In a twelfth embodiment the present invention provides a creped wet pressed tissue product of the tenth or the eleventh embodiment having a GMT from about 700 to about 900 g/3" and a geometric mean slope (GM Slope) from about 10 to about 15.

In a thirteenth embodiment the present invention provides a creped wet pressed tissue product of any one of the tenth through twelfth embodiments having a TS7 value less than about 10.0.

In a fourteenth embodiment the present invention provides a creped wet pressed tissue product of any one of the tenth through thirteenth embodiments having two plies and basis weight from about 40.0 to about 60.0 gsm and more preferably from about 44.0 to about 54.0 gsm.

In a fifteenth embodiment the present invention provides a method of producing creped tissue product comprising the steps of: dispersing cellulosic fibers to form a fiber slurry, disposing the fiber slurry on a forming fabric to form a wet tissue web, partially dewatering the wet tissue web, applying a conventional creping composition to a creping cylinder, pressing the partially dewatered tissue web to the creping cylinder, drying the tissue web, creping the dried tissue web from the creping cylinder, calendering the tissue web, and plying two calendered tissue webs together, wherein each ply of the tissue product has a basis weight greater than 20 gsm, and the product has a GM Stretch greater than about 12 percent and a Stiffness Index less than about 20.

In a sixteenth embodiment the present invention provides the method of the fifteenth embodiment wherein the creping composition comprises a water soluble polymer selected from the group consisting of polyamidoamine-epichlorohydrin resin, polyamine-epichlorohydrin resin, polyvinyl alcohol, polyvinylamine, polyethyleneimine, polyacrylamide, polymethacrylamide, poly(acryiic acid), poly(methacrylic acid), poly(hydroxyethyl acrylate), poly(hydroxyethyl methacrylate), poly(n-vinyl pyrrolidinone), poly(ethylene oxide), hydroxyethyl cellulose, hydroxypropyl cellulose, guar gum, starch, agar, chitosan, alginic acid, and carboxymethyl cellulose.

In a seventeenth embodiment the present invention provides the method of the fifteenth or sixteenth embodiments wherein the conventional creping composition is applied to the creping cylinder at add-on levels greater than about 10 $mg/m^2$.

In an eighteenth embodiment the present invention provides the method of the fifteenth through seventeenth embodiments wherein the crepe ratio is from about 30 to about 40 percent.

In a nineteenth embodiment the present invention provides the method of the fifteenth through eighteenth embodiments wherein the creping composition comprises an adhesive agent and a release agent and wherein the ration, on a mass basis, of adhesive agent to release agent is from about 2:1 to about 2:1.5.

What is claimed is:

1. A creped tissue product having two creped, wet-pressed, tissue plies, each ply having a basis weight 20.0 to about 28.0 gsm, the product having a GM Stretch from about 12 to about 16 percent, a GMT from about 600 to about 900 g/3" and a Stiffness Index less than about 20.

2. The creped tissue product of claim 1 having a MD Stretch from about 30 to about 35 percent.

3. The creped tissue product of claim 1 having a CD Stretch from about 5.0 to about 7.0 percent.

4. The creped tissue product of claim 1 having a GMT from about 700 to about 900 g/3" and a geometric mean slope (GM Slope) from about 10 to about 15.

5. The creped tissue product of claim 1 having a TS7 value less than about 10.0.

6. The creped tissue product of claim 1 having a GMT from about 700 to about 900 g/3" and a Stiffness Index from about 15.0 to about 17.0.

7. The creped tissue product of claim 1 wherein each ply has a basis weight from about 22.0 to about 25.0 gsm.

* * * * *